US006053574A

United States Patent [19]

Opsvik

[11] Patent Number: 6,053,574

[45] Date of Patent: Apr. 25, 2000

[54] DEVICE FOR ADJUSTING THE TILTING RESISTANCE OF A CHAIR SEAT

[75] Inventor: Peter Opsvik, Oslo, Norway

[73] Assignee: Peter Opsvik AS, Oslo, Norway

[21] Appl. No.: 09/091,675

[22] PCT Filed: Dec. 18, 1996

[86] PCT No.: PCT/NO96/00293

§ 371 Date: Jun. 18, 1998

§ 102(e) Date: Jun. 18, 1998

[87] PCT Pub. No.: WO97/22283

PCT Pub. Date: Jun. 26, 1997

[30] Foreign Application Priority Data

Dec. 18, 1995 [NO] Norway ..... 955140

[51] Int. Cl.[7] ..... A47C 1/02

[52] U.S. Cl. ..... 297/337; 297/303.1; 297/303.2; 297/303.3; 297/303.4

[58] Field of Search ..... 297/337, 303.1, 297/303.2, 303.3, 303.4, 302.1, 302.3, 302.4, 353

[56] References Cited

U.S. PATENT DOCUMENTS

| | | | |
|---|---|---|---|
| 2,195,241 | 3/1940 | Cramer et al. | 297/303.1 X |
| 3,659,819 | 5/1972 | Wolters | 297/302.3 X |
| 4,025,020 | 5/1977 | Goff et al. | 297/302.4 X |
| 4,718,726 | 1/1988 | Estkowski et al. | 297/302.3 X |
| 4,852,943 | 8/1989 | Roper | 297/302.1 X |

FOREIGN PATENT DOCUMENTS

| | | |
|---|---|---|
| 159335 | 9/1988 | Norway . |
| 160406 | 1/1989 | Norway . |

*Primary Examiner*—Laurie K. Cranmer
*Attorney, Agent, or Firm*—Watson Cole Grindle Watson, P.L.L.C.

[57] ABSTRACT

For automatically adjusting the tilting resistance of a chair seat (6), which is tiltably attached on a base column (1) via a horizontal shaft provided across the chair, and where tilting resistance and springing are determined by two spring elements (13, 14), one spring is compressed by tilting in one direction and the other spring compressed by tilting in the opposite direction. The spring force is adjustable. In order to be able to adapt the tilting resistance to the seat's/backrest's setting automatically, the spring elements (13, 14) are connected to the seat/backrest by mans of a connecting element which directly influences their spring force by an adjustment of the seat and/or backrest.

19 Claims, 9 Drawing Sheets

DEVICE FOR ADJUSTING THE TILTING RESISTANCE OF A CHAIR SEAT

BACKGROUND OF THE INVENTION

1. Field of the Invention

The invention concerns a device for adjusting the tilting resistance of a chair seat, on its own, or a chair body with seat and backrest. This adjustment should be performed in connection with a chair seat which can be moved in the longitudinal direction (or a backrest which is movable in the height direction), the seat being tiltably attached on a base column via a horizontal shaft provided across the chair, wherein tilting resistance and springing are determined by two spring elements, one spring being compressed by tilting in one direction and the other spring being compressed by tilting in the opposite direction, and wherein the spring force is adjustable. An embodiment where the distance between the chair seat's tilting axis and spring element is altered is disclosed, e.g., in applicant's NO patent no. 160 406.

2. The Prior Art

There are previously known chairs, e.g., office chairs, of the above-mentioned type. In these chairs, between the seat and the chair frame there are provided two springs whose spring force can be varied by means of screw devices for separate adjustment of each spring. If the chair frequently changes owner, such a constant alteration of the spring force or the springs' position is difficult to work out, time-consuming and tiresome.

If the chair is used by several different people, i.e., people of different build and weight, each person will have to adjust the springs separately and individually in order to obtain optimum sitting comfort. It has therefore been a requirement to produce a setting or adjusting mechanism for the tilting resistance in a chair seat or chair body, where adjustment can be performed without the need for the user to think or do anything about it. Tall people who require a deep chair seat place a greater load on the tilting resistance than small people, since they are both heavier and taller and create a greater weight moment. Small people who will like a short seat place a smaller load on the tilting resistance both since they are light and since they create a smaller weight moment.

The invention is intended for use in chairs where the seat and possibly the chair back are adjustable in order to adapt the chair's dimensions to different people's size. When the chair seat is pushed forwards and backwards in its longitudinal direction (or the backrest in its height direction), this moves both the tilting resistance means away from and closer to the seat's or the chair body's tilting point respectively. The result of this is that people who are tall and prefer a deep seat/high backrest and adjust the chair accordingly will automatically create greater (harder) tilting resistances both for forward tilt and backward tilt. Similarly, a short person who wishes a short seat/low backrest and adjusts the chair accordingly automatically creates less (weaker) tilting resistances.

The object of the invention is therefore to permit an automatic adaptation of the tilting resistance in such chairs with chair seats which are adjustable in the longitudinal direction, and/or backrests which are adjustable in the height direction.

With such adjustable chairs, however, the situation may still arise where individuals require an adjustment beyond this normal relationship, e.g. a tall person who is very light. Thus it is a further object of the invention to provide a possibility for such a special adjustment, such as weak tilting resistance even though the seat is set in the deep position. The term "normal relationship" should be understood to mean that the chair's functions are arranged so that they move simultaneously in a certain relationship to one another in order to be able to provide satisfactory conditions for different body sizes.

In order to prevent the special setting from being disadvantageous for the next user of the chair, the invention has been implemented in such a manner that when the seat depth is adjusted, special settings automatically return to the normal relationship between the functions.

SUMMARY OF THE INVENTION

According to the present invention a connecting element connects the spring elements to the seat/backrest to obtain automatic adjustment of the tilting resistance in a chair seat/chair body which has a seat which can be pushed forwards and backwards and a backrest which can be moved up and down, the adjustment of the tilting resistance being designed manually or automatically and if desired also including a mechanism for returning the device to the normal relationship. A device is thereby provided which simplifies the handling of the chair's adjustment possibilities, thus enabling a user to adjust many functions simultaneously with one operating movement, and the seat/backrest to move in a normal relationship in relation to each other, the chair thereby being suited to people of different builds.

The connecting element which is activated when the seat and/or backrest are adjusted may be designed in many different ways. The essential feature is that when adjustment takes place this connecting body should influence the spring elements which control the tilting resistance of the chair, thus producing an automatic adjustment.

The invention will now be explained in more detail by means of a number of embodiments which are illustrated in the drawings.

BRIEF DESCRIPTION OF THE DRAWINGS

FIGS. 5*a*–10*b* illustrate the principle for other embodiments of the connecting element in a device according to the invention, viewed in a schematic side view, where FIGS. 5*a*, 6*a*, 7*a*, 8*a*, 9*a* and 10*a* illustrates the seat in the rear position, and FIGS. 5*b*, 6*b*, 7*b*, 8*b*, 9*b* and 10*b* illustrates the seat in the forward position.

DETAILED DESCRIPTION OF THE PREFERRED EMBODIMENTS

The embodiment in FIGS. 1–4 is based on the applicant's NO patent no 160.406 which describes a manually operated mechanism. For the sake of clarity a description is also included in the following of features which are also employed in the manual adjusting mechanism in the noted patent. In this connection it should be pointed out that other designs are also possible, e.g., the use of tilting bodies which work jointly via curved interfaces, various rotating bodies, etc.

Figure 1A:
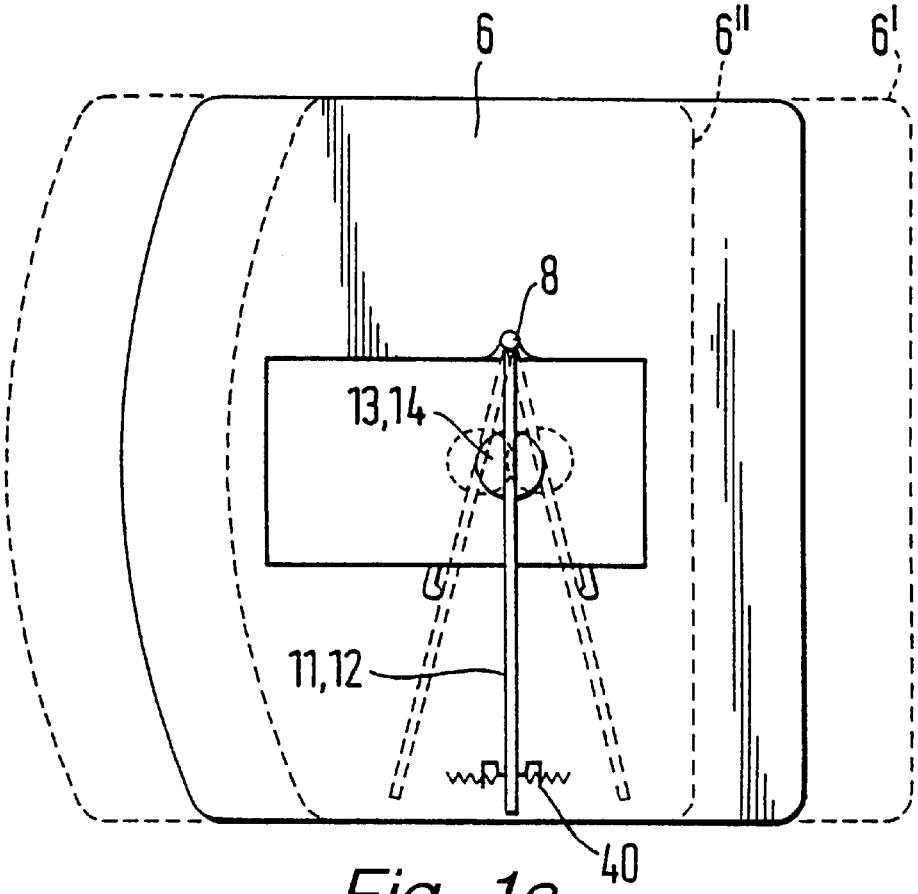
FIGS. 1*a* and 1*b* are schematic views illustrating a first embodiment of the invention, provided on a chair seat, viewed from below and from the side, respectively
Figure 1B:
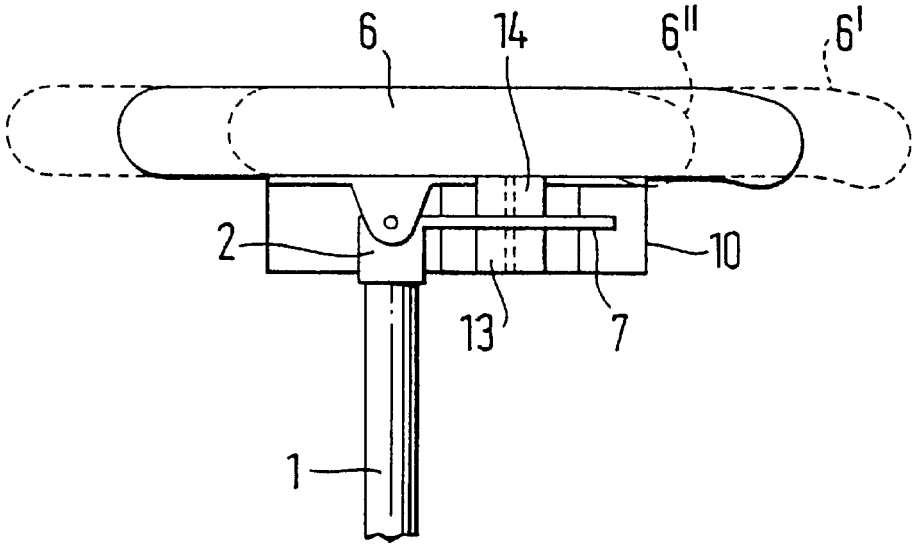

FIGS. 1*a* and 1*b*, which are purely schematic illustrations, are intended to show the method of operation of the device according to the invention provided on the underside of a chair seat. The chair seat is supported on a column 1 via fastening 2 to which a support fame for a seat is affixed. Below the seat at the front edge there is fitted a housing 10 in which there are mounted spring elements 13 and 14, which are separated by means of a dividing plate 7 which is firmly connected to the fastening 2. The springs 13, 14 are mounted on arms 11, 12 which can be moved forwards and backwards in the chair seat's longitudinal direction, as illustrated by dotted lines in FIG. 1*a*, the arms being rotatable about a rotating fitting 8. By moving the rods which can be locked in a fastening 40, the springs 13, 14 will be moved forwards and backwards in the seat's longitudinal direction, thereby adjusting the tilting resistance for the seat about the fastening 2.

FIGS. 1*a* and 1*b* illustrate that the chair seat 6 can be pushed forwards and backwards, e.g., between a position 6' in the forward position and a position 6" in the rear position. If the rod-like arms 11, 12 are attached to the chair seat and accompany it forwards and backwards, the adjustment of the tilting resistance will be altered automatically when the chair seat is moved. The various alternatives are illustrated in more detail in FIG. 2.

As mentioned above, the chair's underbody frame has a vertical column 1. The upper section thereof is linked to two fittings or brackets 2, which are firmly connected to a sliding plate 3. The sliding plate 3 forms a sliding guide for two tracks 4 which are firmly connected via lugs 5 to the underside of a seat 6. This describes the embodiment with a movable seat, and it is this embodiment which is employed as the main illustration of the invention. The invention can also be used in chairs with a fixed seat but with a backrest which is moved straight or slantingly upwards and backwards. The tilting resistance means are moved from the tilting point (under the seat) when the backrest is moved upwards.

The sliding plate 3 extends substantially perpendicularly to the longitudinal axis of column 1. To the underside of the sliding plate there is attached a rotating block 8 which can rotate about an axis 9 which extends perpendicularly to the plate. Furthermore, to the underside of the plate there is attached a housing 10 which is U-shaped in cross section and through which the clamp plate 7 extends, the walls of the housing, i.e., the legs of the U-cross section being connected to the underside of the plate 3 and the housing's ceiling, i.e., the bottom of its cross section is thereby located at a distance from the underside of the plate.

To the rotating block 8 there are attached two rod-shaped arms 11, 12, whose spacing is considered in the direction of the axis 9, the arms extending substantially parallel to the dividing plate 7, and on each side thereof and through long slits 15 in the housing's lateral walls as well as perpendicularly to the tracks 4. The arms can be slightly flexible. Alternatively, instead of a rotating block which is made in one piece, two coaxial rotating blocks can be provided which can rotate in relation to each other about the axis 9, and each of which has an arm 11 and 12, respectively.

The arms 11, 12 also each extend through an elastically yielding spring piece 13, 14 at the point where the arms pass the dividing plate 7 and through the housing 10. (The spring pieces 13, 14 with friction can be movable in the arms' longitudinal direction).

The upper and the lower end surface of the upper spring piece 14, i.e., the spring piece which is located closest to the underside of the sliding plate 3, can abut against this underside or the upper surface of the dividing plate 7.

The upper and the lower end surface of the lower spring piece 13 can abut against the underside of the dividing plate 7 or the top, i.e., the inside of the housing. When the housing 10 is moved, the dividing plate 7 will thereby exert a clamping effect on the spring pieces and can therefore also be described as a clamp plate.

According to the invention there are attached to the underside of the plate 3 two brackets 20, 21, which extend substantially perpendicularly to the tracks 4 at intervals in the tracks' longitudinal direction. The surface of the brackets via which these are attached to the plate are indicated by reference numeral 26. The section of each bracket which faces away from the plate is in the form of a fork, the spacing of whose two prongs 22, 23, 24, 25 is considered in the direction perpendicular to the sliding plate's plate plane.

Each of the prongs is equipped with a saw-tooth-shaped end section, the teeth extending in a plane which extends perpendicularly to the prongs' longitudinal direction and the tooth points of the prongs of the same fork facing away from one another in the direction substantially perpendicular to the sliding plate's plate plane.

Figure 2:
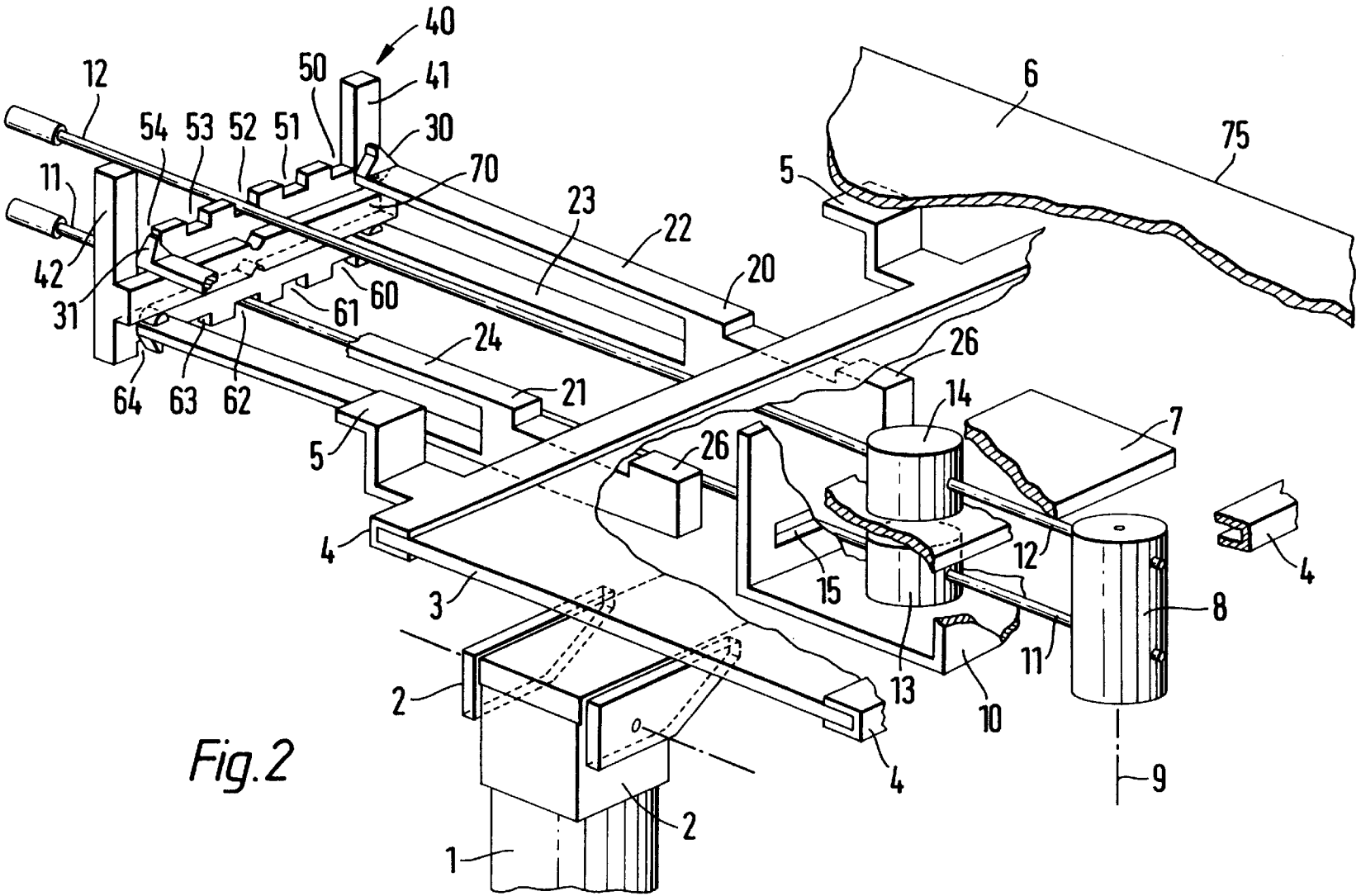
FIG. 2 is a perspective view of the device in FIG. 1, where parts of individual elements have been cut away in order to show underlying parts.
Figure 3A:
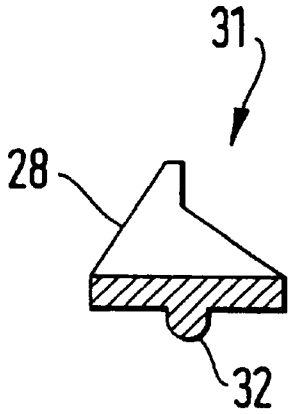
FIGS. 3*a* and 3*b* are sectional views illustrating the design of the end section of two arms in the device according to the invention.
Figure 3B:
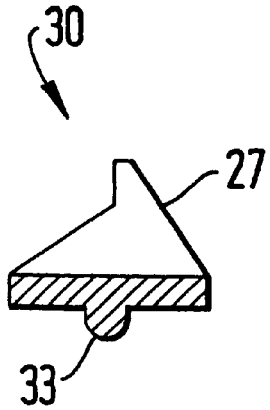

FIGS. 3*a* and 3*b* are sections through the saw-tooth-shaped end section of the fork prongs 22 and 24 of respective brackets 20, 21. As illustrated in FIG. 2, the teeth 30, 31 have respective slantingly extending flanks 27, 28 which face away from each other. These flanks extend in profile rectilinearly from the root of the tooth to the top of the tooth.

The lower area of the sides of the teeth which face one another has a slantingly extending tooth flank section which, however, near the top of the tooth turns into a tooth flank section which extends perpendicularly to the sliding plate's plate plane.

On the side of each end section which faces away from the top of the tooth, each tooth has a collar 32, 33.

The prongs 22, 23, 24, 25 are elastically flexible perpendicular to the sliding plate's plate plane.

At the end sections of the prongs there is attached to the underside of the chair seat a substantially downwardly projecting plate or bridge 40 which is U or H-shaped in profile, the foot section of the bridge's leg 41, 42 like the foot section of the housing's leg, facing upwards.

The section of the bridge 40 which is located between the legs 41, 42, considered in the direction perpendicular to the sliding plate, is equipped with a row of notches 50–54 and 60–64 respectively which are arranged at regular intervals. Between these notches and on the side of the bridge which faces the sliding plate, the bridge has a contact section 70 which projects towards the sliding plate. The sides of the contact section which face away from each other in the direction perpendicular to the sliding plate are provided as contact surfaces for the prongs' collar 32, 33. At the central section of the contact surfaces there is further provided a recess with slantingly extending sides in which the beads can be accommodated. Due to their springing, the prongs with their collars attempt to abut against the respective contact surfaces.

The device works in the following manner:

When the chair seat 6 is pushed in one direction, it will be accompanied by the bridge element 40 which is attached to the underside of the seat. The rods which are located in the central recess of the recesses 50–54 and 60–64 respectively and secured in the recess, will accompany the adjusting mechanism 40 and the arms 11, 12 will be rotated about the rotating body 8. The spring blocks 13, 14 will thereby be pushed aside and alter the tilting resistance. If a tilting resistance means is secured, the flexible rod will be bent and placed under tension.

By tilting the chair seat in relation to the chair's column in such a manner that the seat's front edge 75 is moved down, the upper spring block 14 is compressed in the known manner between the sliding plate and the dividing or clamp plate 7, while the pressure is relieved on the lower spring piece 13. The relieved tilting resistance means will then jump into place as the spring rod is straightened out. By tilting in the opposite direction the lower spring block 13 will come into effect in a similar fashion. In this way an automatic adjustment of the spring resistance is obtained and thereby the tilting resistance for the seat in step with a forward and backward movement of the seat 6.

Should one wish to deviate from the normal relationship, one can take hold of the operating handles at the ends of the arms 11 and 12, lift or lower the arms to release then from the notch in which they are located and move the arm and thereby the spring block forwards or backwards. The drawing only indicates the simplest possible way of doing this with separate movement of the two spring blocks, but it is quite obvious that the mechanism can be designed here to enable this movement to be performed synchronously and that the arms 11, 12 can be connected, so that only one handle has to be operated. Thus the device can also be employed for manual adjustment.

If the device is employed for automatic adjustment of the tilting resistance, as explained above on a chair which a movable seat, there is also incorporated in the illustrated device a mechanism for even more "extreme" adjustment of the spring resistance in both directions. The normal adjustment is performed automatically in step with the movement of the seat, as explained above. Should the user of the chair wish a further movement, e.g., forwards in the direction towards the seat's front edge 75, he grips the lever or arm 12, lifts the arm 12 out of the notch 52 and moves the arm, e.g., to the notch 50. An additional adjustment will thereby be achieved beyond that which was achieved with the automatic adjustment.

In order to avoid the necessity for a "normal" person later having to reset the tilting resistance to normal by moving the lever, in the illustrated embodiment there is provided a control mechanism which performs this automatically when the seat depth is adjusted. If the arm 12 is located in the notch 50, i.e. in the most rigid position, the chair seat 6 has to be pulled even further forward and the mechanism 40 will thereby be pushed forward in relation to the prongs 22, 23 and the arms 11, 12 will abut against the bevel edge of the end section or the tooth 30, 31 and be lifted out of the recess 50. It will then be gripped by the upper straight edge of the tooth and secured there while the bridge 40 is moved further on. This position will be maintained while the prongs 22, 23 slide on the collar 33 along the contact surface of the mechanism 40 until it reaches the notch in the middle of the bridge, where the prong will be lowered when the collar goes into the notch. The arm will thereby be released and be lodged in the central recess 52. The seat can then be pushed back and the adjusting mechanism is returned to neutral. A corresponding resetting can also be undertaken from another side by means of the other prongs 24, 25.

In FIGS. 4*a*–10*b* a number of further embodiments of the invention are illustrated. In these figures the principle design according to the invention is essentially illustrated without going into details, and no further examples of resetting devices and the like are illustrated.

Figure 4A:
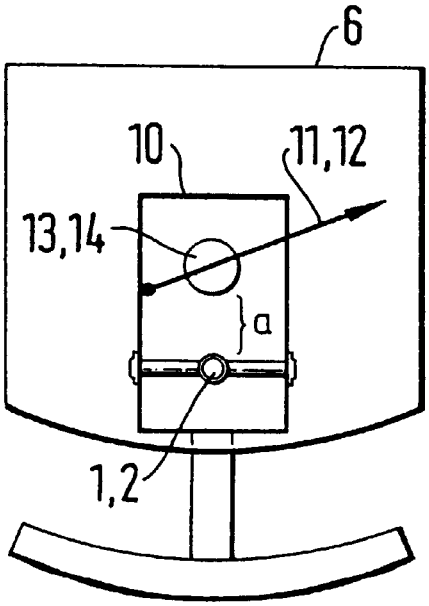
FIGS. 4*a* and 4*b* are principal drawings corresponding to FIG. 1*a*, but with the seat viewed in a forward and rear position, respectively
Figure 4B:
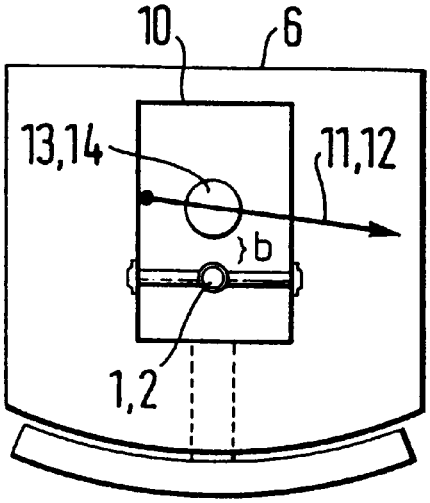

FIGS. 4*a* and 4*b* illustrate the principle which is described in detail in connection with FIGS. 1*a*–3*b*, two views from above being shown here, with the chair seat 6 in the forward position and the rear, withdrawn position respectively. It can be seen that the distance from the column and the tilting point in the joint 2 to the spring element, which distance is indicated by a, is greater when the seat 6 is extended than when the seat is withdrawn, where this distance is indicated by b. This change in distance is instrumental in altering the tilting resistance. In this embodiment spring wires are employed as arms.

The remaining FIGS. 5*a*–10*b* illustrate the invention in schematic side views.

Figure 5A:
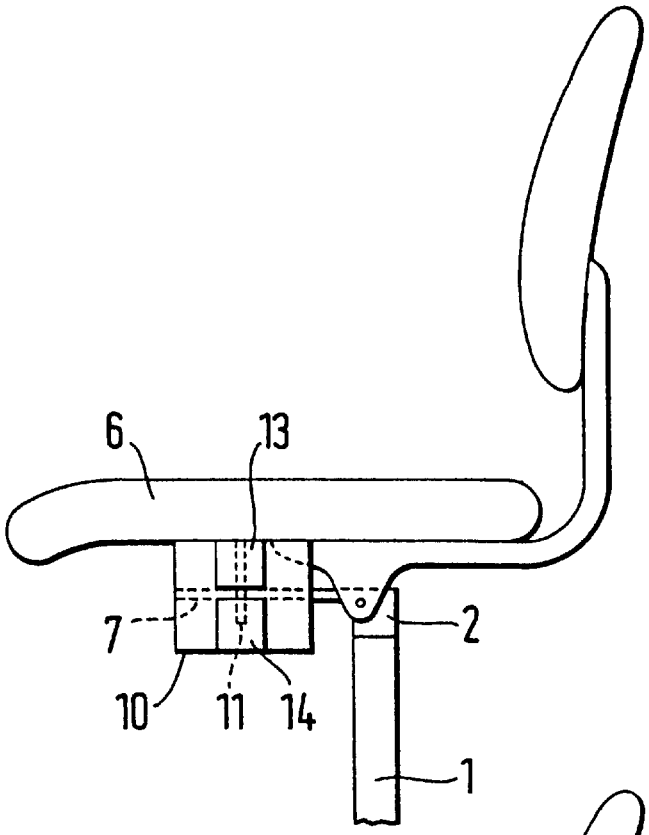
Figure 5B:
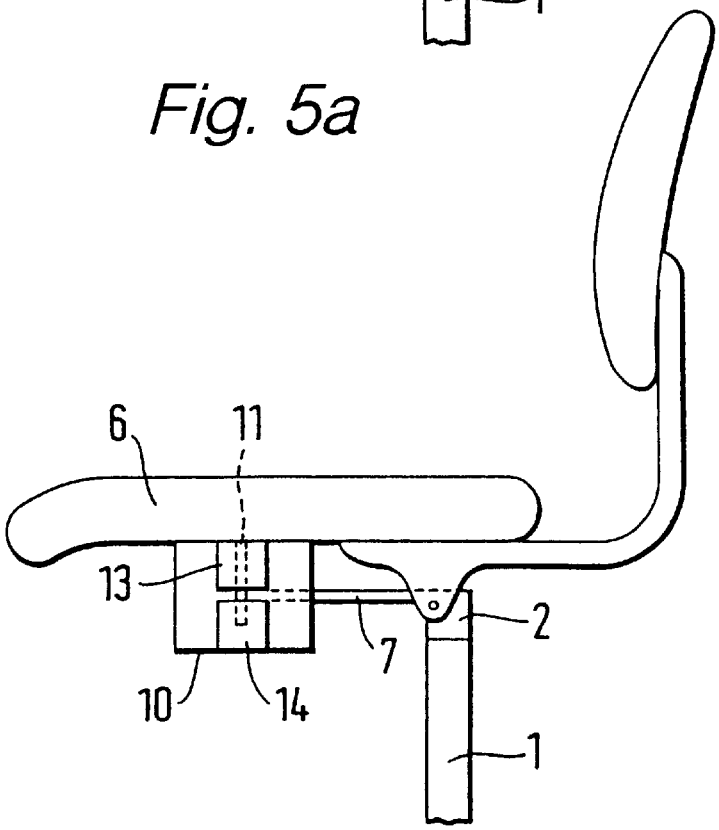

FIGS. 5*a* and 5*b* illustrate a design with a dividing plate 7 in a housing 10 and with spring elements 13 and 14, i.e., a similar construction to that in the preceding figures. In this case, however, the movement of the spring elements is provided by fitting a mortise-and-tenon joint 11 to the seat, which tenon will pull the spring elements 13 and 14 along with it when the seat is moved. A similar effect is thereby achieved as in the above-described embodiments.

Figure 6A:
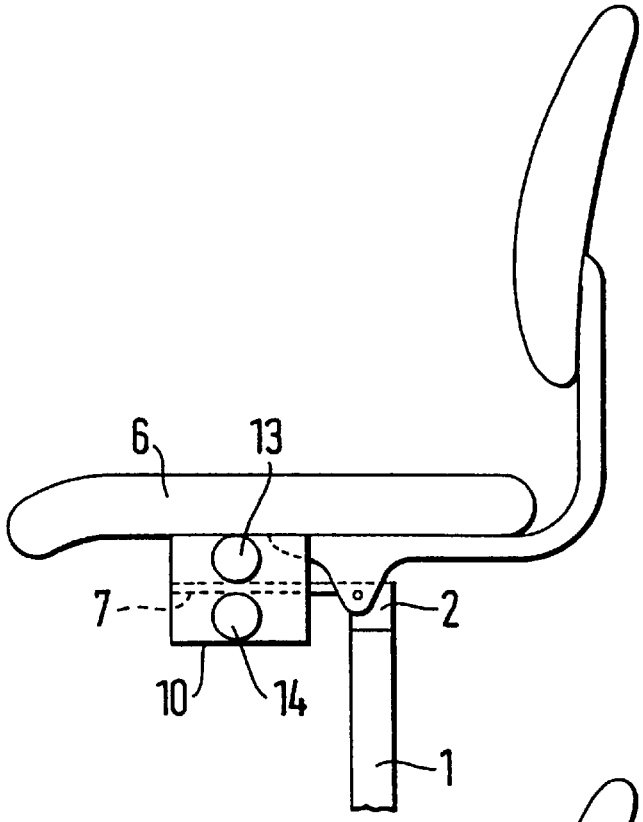
Figure 6B:
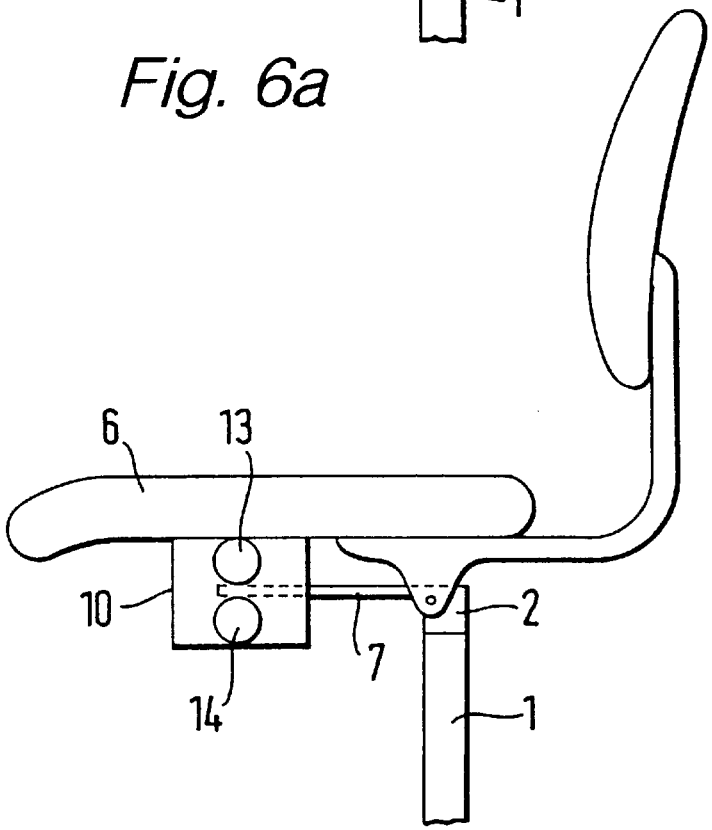

FIGS. 6*a* and 6*b* illustrate a similar construction, but in this case the spring elements 13 and 14 are in the form of rollers, where the rollers accompany the seat forwards and backwards, thereby altering the tilting resistance.

Figure 7A:
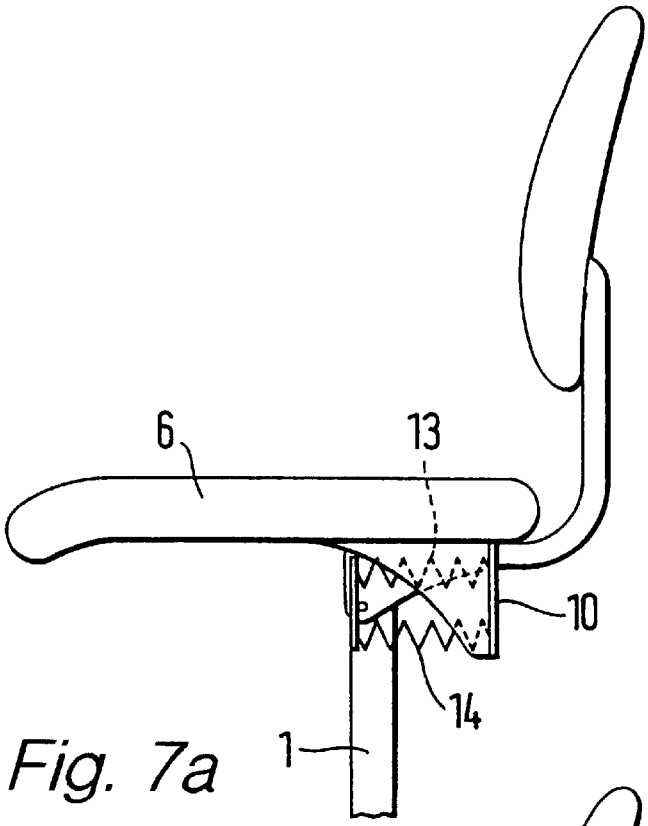
Figure 7B:
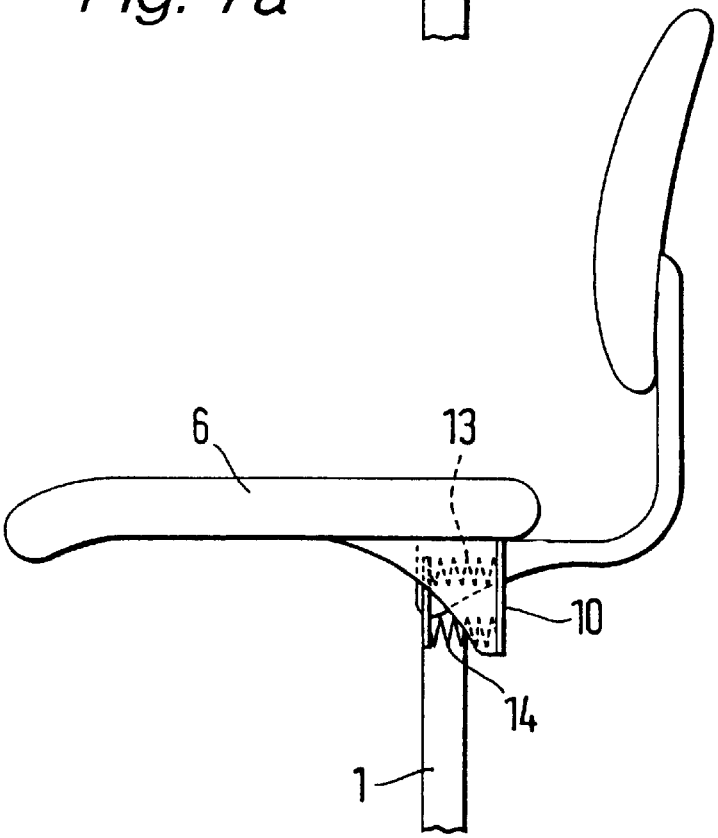

FIGS. 7*a* and 7*b* illustrate a design with compression of the spring elements 13 and 14. Here the housing 10 is in the form of a plate at the rear edge of the column member 1, where the rear part of the housing is movable, while the front part is attached to the column 1. When the seat is moved forwards the springs will be compressed, thus altering the tilting resistance.

Figure 8A:
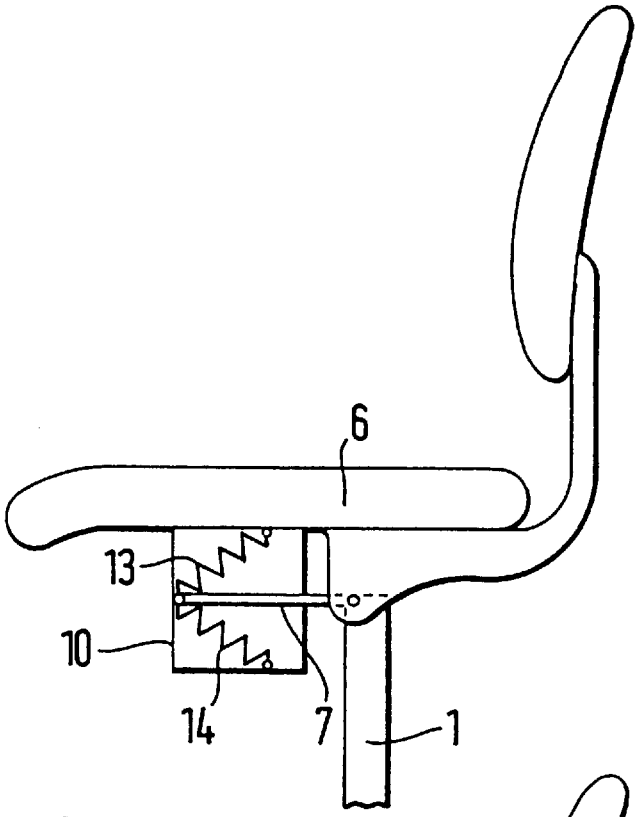
Figure 8B:
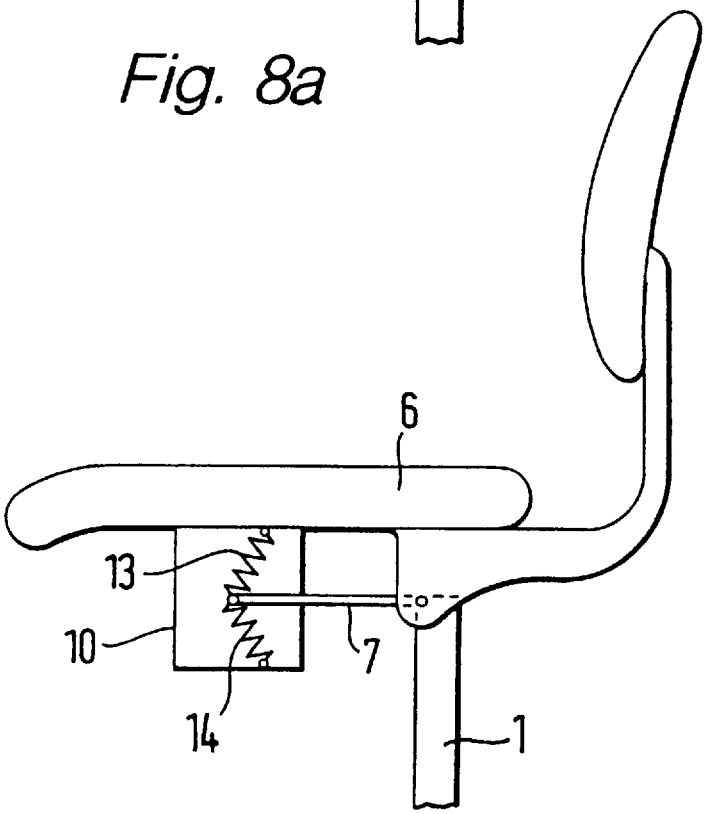

A variation of this design is illustrated in FIGS. 8*a* and 8*b*, where the spring elements 13, 14 are again provided inside the housing, but firmly attached to the dividing plate 7. The other end of the spring element is attached to the floor or the roof of the housing respectively. As the illustration in the drawing indicates, moving the seat and thereby the housing will cause an alteration in the tilting resistance by a combination of a change in the spring compression together with an increase in the spring distance from the tilting point and change in the spring path.

Figure 9A:
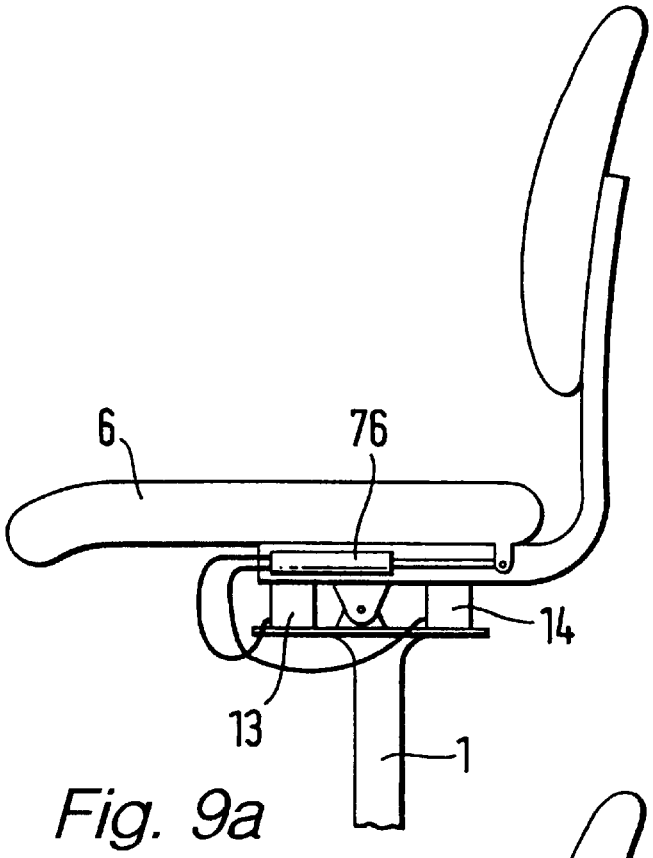
Figure 9B:
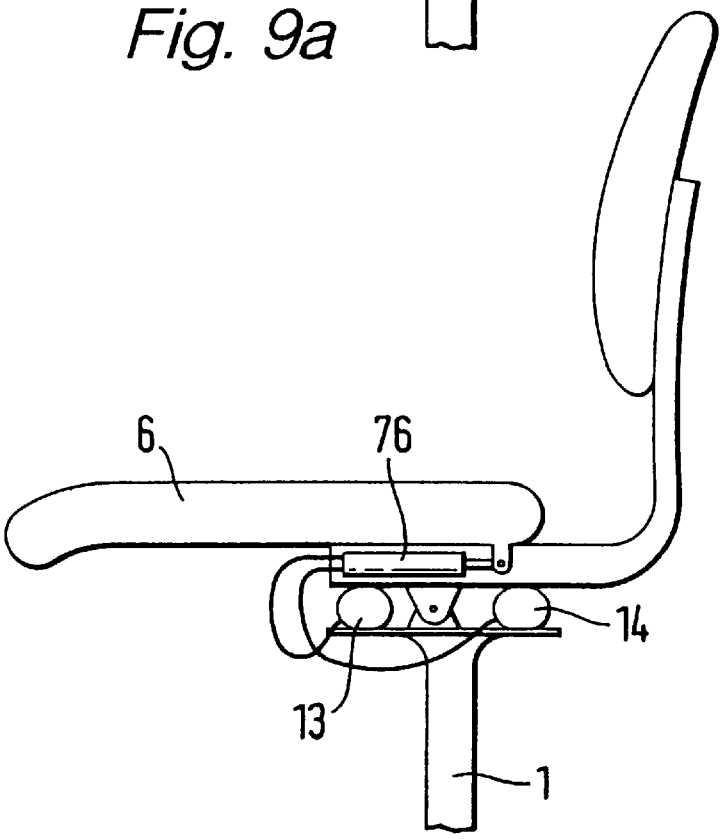

FIGS. 9*a* and 9*b* illustrate a variation in which a gas cylinder or a hydraulic cylinder is employed. In this version a movement of the seat will generate a piston stroke in a cylinder 76, which will cause the inflatable spring bodies 13, 14 to be pumped up or the pressure therein to be reduced.

Figure 10A:
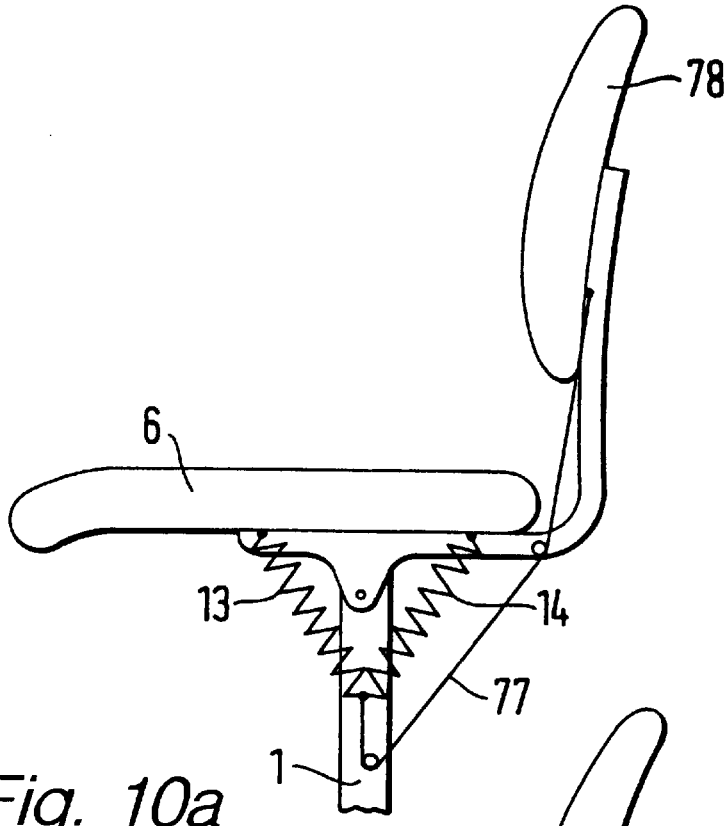
Figure 10B:
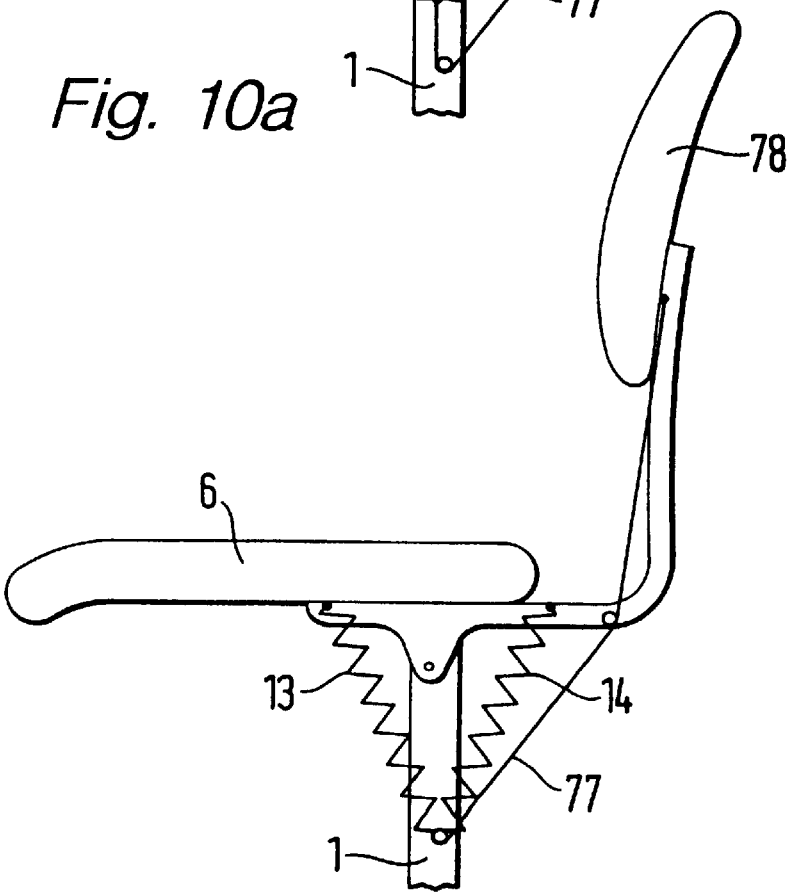

Finally in FIGS. 10*a* and 10*b* a design is illustrated in which the spring elements 13 and 14 are connected and attached by a cord drive to the chair's back portion 78. By moving the back part upwards the cord 77 will be tightened and extend the springs 13 and 14. A similar device can of course also be attached to the seat part.

With the chair mechanism according to the invention an automatic adjustment is achieved of the moment which counteracts the tilting of the seat, depending on the seat's position in relation to the chair frame while it is being adapted to suit people of different height, but where the ratio between the people's height and weight conforms to a standard or normal variation among the population.

If the chair is used by people whose height/weight ratio deviates from the norm, the counter-moment can be altered in such a way that the variation thereof deviates from the normal variation.

If, after having been used by a person whose height/weight ratio deviates from the norm, the chair is used by a person whose height/weight ratio is normal, the normal relationship will automatically be restored when the new user adjusts the seat depth by more than a half turn.

Even though the invention is described in connection with a movable seat, it will also be able to be employed in connection with a height-adjustable backrest. In this case the mechanisms which are described will be connected to a movable plate element which is controlled by the height adjustment. Several modifications will be possible here. As mentioned above, various types of tilting bodies and adjusting mechanisms can be employed within the scope of the invention.

I claim:

1. A device for automatically adjusting tilting resistance of a movable part of a chair which is tiltably attached on a base column via a horizontal shaft provided across the chair, wherein tilting resistance is determined by two spring elements, one spring element being compressed by tilting in one direction, and wherein the spring force is adjustable, wherein said spring elements are connected to the seat by means of a connecting element which directly influences spring force of the spring elements by an adjustment of the seat.

2. A device according to claim 1, wherein the connecting element is a spring wire or arm connection between the spring elements and the movable part, for moving of the spring elements.

3. A device according to claim 2, wherein the two arms on which the spring elements sit are resilient, with the result that when the seat/backrest is moved, the arms bend, are placed under tension, and are released when the chair is tilted, the spring elements thereby moving to the correct location.

4. A device according to claim 1, wherein the connecting element is a mortise-and-tenon joint between the movable part and the spring elements.

5. A device according to claim 1, wherein the spring elements are in the form of rollers which are connected in order to be moved together with the movable part.

6. A device according to claim 1, wherein the spring elements are compression springs which are arranged between a fixed wall and a wall which is movable with the seat.

7. A device according to claim 1, wherein the spring elements are springs which are attached at one end to an upper and a lower part of a housing which is movable with the seat part and attached at the other end to a dividing plate.

8. A device according to claim 1, wherein the spring elements are elements which can be filled with fluid, where the degree of filling is regulated by a piston/cylinder device which is influenced by the movable part.

9. A device according to claim 1, wherein the spring elements are springs which are connected at one end to a frame of the chair and connected together at another end, and connected at this another end with cord drive which is influenced by a movement of a seat and/or back part of the chair.

10. A device according to claim 9, wherein the spring elements are rotatable in relation to each other and work jointly over a curved contact surface, which moves the elements when rotated, or that the rotating mechanism is designed with a screw pitch which causes reciprocal movement.

11. A device according to claim 1, wherein the spring elements are each attached to an arm which extends from a rotating body on one side of a seat of the chair longitudinal axis, past the spring elements to an adjusting area on the opposite side of the chair seat, where the arms end in an adjusting mechanism where the arms are connected to the movable chair seat or a backrest adjusting mechanism, thereby being adjusted automatically when the seat is moved.

12. A device according to claim 11, where the chair seat is movable in the seat's longitudinal direction, the seat being attached movably on a mounting plate firmly connected to the chair's column, wherein the adjusting mechanism is attached to the underside of the seat, the adjusting mechanism having at least one stop piece for accommodation of the arms.

13. A device according to claim 11, wherein the adjusting mechanism is designed as a U or H-shaped bridge element attached to the underside of the chair seat, where the bridge element is designed with a ratchet for locking the arms in a desired adjusting position via the operating bodies.

14. A device according to claim 11, including a mounting plate connected to the column of the chair, said seat being movably attached to the mounting plate, two arms attached to the mounting plate which are directed towards the adjusting mechanism, and which are divided in the outer area into two prongs which in the area near the bridge member rest via a collar on a contact surface on the bridge member, and on the opposite side are equipped with saw-tooth-shaped end sections in the area where the arms are located, and which have slanting contact surfaces for the arms together with an upper arm capture device on the inside and that in its central area the contact surface has a recess corresponding to the collar.

15. A device according to claim 14, wherein the prongs are placed under tension towards the contact surfaces.

16. A device according to claim 11, wherein the arms are formed as a resilient rod.

17. A device according to claim 11, wherein the rotating body is designed as two coaxial blocks which are rotatable about a common axis.

18. A device according to claim 11, where the spring elements are made of an elastic block material and wherein the arms are passed through the blocks.

19. A device according to claim 1, 2 or 11, where the spring elements are tightened/slackened by being pushed to and from a tilting point in a specific normal relationship, but where this relationship can be deviated from, wherein a seat depth/backrest height adjusting mechanism is designed with a setting which causes a special setting of the tilting resistance to return to a normal relationship.

* * * * *